US010035275B2

(12) United States Patent
Hawes et al.

(10) Patent No.: US 10,035,275 B2
(45) Date of Patent: Jul. 31, 2018

(54) FLUID DISPENSING HAIR REMOVAL DEVICE

(75) Inventors: Christopher Martin Hawes, Reading (GB); Lee Burrowes, Horsell (GB); James Leo Salemme, Billerica, MA (US)

(73) Assignee: The Gillette Company LLC, Boston, MA (US)

( * ) Notice: Subject to any disclaimer, the term of this patent is extended or adjusted under 35 U.S.C. 154(b) by 1440 days.

(21) Appl. No.: 12/581,366

(22) Filed: Oct. 19, 2009

(65) Prior Publication Data

US 2010/0095528 A1 Apr. 22, 2010

Related U.S. Application Data

(60) Provisional application No. 61/106,258, filed on Oct. 17, 2008.

(51) Int. Cl.

| | |
|---|---|
| ***B26B 21/44*** | (2006.01) |
| ***B26B 19/40*** | (2006.01) |
| *A45D 26/00* | (2006.01) |

(52) U.S. Cl.

CPC ..... *B26B 21/446* (2013.01); *B26B 19/40* (2013.01); *A45D 2026/008* (2013.01)

(58) Field of Classification Search

CPC ..... B26B 19/40; B26B 21/40; B26B 21/52; B26B 21/446

USPC ..... 30/41, 41.5; 401/183–186; 222/105, 222/212, 213

See application file for complete search history.

(56) References Cited

U.S. PATENT DOCUMENTS

| | | | | | |
|---|---|---|---|---|---|
| 1,899,841 | A | * | 2/1933 | Acken | 30/41 |
| 2,300,512 | A | * | 11/1942 | Landau | 30/41 |
| 3,088,470 | A | * | 5/1963 | Hall | 132/320 |
| 3,139,683 | A | * | 7/1964 | Waldman | 30/41 |
| 3,256,894 | A | * | 6/1966 | Sherman | 401/188 R |
| 3,295,204 | A | * | 1/1967 | Brophy | 30/41.5 |
| 3,412,465 | A | * | 11/1968 | Anderson | 30/41 |
| 3,738,762 | A | * | 6/1973 | Moore et al. | 401/186 |
| 3,985,146 | A | * | 10/1976 | Albach | 30/41 |
| 4,696,106 | A | * | 9/1987 | Cross et al. | 30/41 |
| 4,716,652 | A | * | 1/1988 | Cataudella | 30/41 |
| 4,800,649 | A | * | 1/1989 | Cataudella | 30/41 |
| 4,809,432 | A | * | 3/1989 | Schauble | 30/41 |
| 4,850,730 | A | * | 7/1989 | Jimenez et al. | 401/184 |

(Continued)

FOREIGN PATENT DOCUMENTS

| | | | |
|---|---|---|---|
| FR | 2 629 385 | | 3/1988 |
| GB | 2046845 | A * | 11/1980 |

(Continued)

OTHER PUBLICATIONS

PCT International Search Report with Written Opinion in corresponding Int'l appln. PCT/US2009/060771 dated Feb. 3, 2010.

*Primary Examiner* — Jason Daniel Prone

(74) *Attorney, Agent, or Firm* — Ronald T. Sia; Kevin C. Johnson

(57) ABSTRACT

A hair removal device comprising a handle enclosing a collapsible reservoir a, said hair removal device having at least on pressure applicator, such as in the form of a mono-stable button, wherein the mono-stable button is adapted to pressurize air in the handle, thereby collapsing the collapsible reservoir and causing fluid to be expelled from the hair removal device.

8 Claims, 4 Drawing Sheets

(56) References Cited

U.S. PATENT DOCUMENTS 4,888,868 A * 12/1989 Pritchard ..... 30/41
5,121,541 A * 6/1992 Patrakis ..... 30/41
5,316,135 A * 5/1994 Kneer et al. ..... 215/12.1
5,402,573 A 4/1995 Laniado
5,402,697 A * 4/1995 Brooks ..... 30/41
5,435,452 A * 7/1995 Nishigami et al. ..... 215/12.1
5,513,761 A * 5/1996 Kobayashi et al. ..... 215/12.1
5,567,377 A * 10/1996 Nishigami et al. ..... 264/515
5,711,454 A * 1/1998 Kobayashi et al. ..... 222/95
5,761,813 A * 6/1998 Frick et al. ..... 30/41
5,827,001 A * 10/1998 Taghavi-Khanghah ..... 401/184
5,921,438 A * 7/1999 Kobayashi et al. ..... 222/95
5,970,935 A * 10/1999 Harvey et al. ..... 123/179.11
6,109,468 A * 8/2000 Kneer ..... 215/378
6,244,852 B1 * 6/2001 Kneer ..... 264/523
6,257,791 B1 * 7/2001 Scamard ..... 401/183
6,406,207 B1 * 6/2002 Wiegner et al. ..... 401/188 R
6,493,940 B2 * 12/2002 Westerhof et al. ..... 30/41
6,499,218 B2 * 12/2002 Rocha ..... 30/41
D482,200 S * 11/2003 Daniels et al. ..... D4/108
6,670,007 B1 * 12/2003 Safian et al. ..... 215/11.3
6,754,958 B2 * 6/2004 Haws et al. ..... 30/41
6,817,803 B1 * 11/2004 Ong et al. ..... 401/186
6,910,274 B1 6/2005 Pennella et al.
6,925,716 B2 * 8/2005 Bressler et al. ..... 30/41
6,964,097 B2 * 11/2005 Franzini et al. ..... 30/41
7,007,389 B1 * 3/2006 Arif ..... 30/41
7,021,851 B1 * 4/2006 King ..... 401/186
7,043,841 B2 * 5/2006 Franzini et al. ..... 30/41
7,743,506 B2 * 6/2010 Szczepanowski et al. .... 30/41.5
7,901,153 B1 * 3/2011 Strider ..... 401/184
8,069,830 B2 * 12/2011 Brown et al. ..... 123/179.11
8,123,073 B2 * 2/2012 LaFlamme et al. ..... 222/213
8,220,156 B2 * 7/2012 Forsdike ..... B26B 21/446 30/41
8,458,909 B2 * 6/2013 Hawes ..... B26B 21/446 30/41
8,510,957 B2 * 8/2013 Wain ..... B26B 21/446 30/41
8,826,543 B2 * 9/2014 Szczepanowski .... B26B 21/446 30/41
8,887,369 B2 * 11/2014 Burrowes ..... B26B 21/446 30/41
8,931,177 B2 * 1/2015 Wain ..... B26B 21/446 30/41
9,656,401 B2 * 5/2017 Burrowes ..... B26B 21/446
9,789,620 B2 * 10/2017 Wain ..... B26B 19/40
9,833,916 B2 * 12/2017 Shorey ..... B26B 21/44
2002/0023351 A1 2/2002 Simms
2005/0144785 A1 7/2005 Bressler et al.
2005/0144786 A1 7/2005 Bressler et al.
2006/0150386 A1 7/2006 Wanli et al.
2007/0017098 A1 * 1/2007 Bressler et al. ..... 30/41
2008/0184563 A1 * 8/2008 Hamadeh ..... 30/41
2009/0183371 A1 * 7/2009 Mileti et al. ..... 30/41.5
2009/0199806 A1 * 8/2009 Brown et al. ..... 123/179.11
2009/0263176 A1 * 10/2009 Mileti et al. ..... 401/184
2010/0095529 A1 * 4/2010 Hawes et al. ..... 30/41.5
2010/0175261 A1 * 7/2010 Lax ..... 30/41
2010/0218378 A1 * 9/2010 Chenvainu et al. ..... 30/41
2010/0327009 A1 * 12/2010 Hofte ..... 222/1
2011/0289776 A1 * 12/2011 Hawes et al. ..... 30/41
2012/0102742 A1 * 5/2012 Jessemey ..... B26B 21/446 30/41
2012/0103928 A1 * 5/2012 Jessemey ..... A45D 27/00 215/378
2015/0375408 A1 * 12/2015 Shorey ..... B26B 21/446 30/41
2015/0375409 A1 * 12/2015 Shorey ..... B26B 21/446 30/41
2017/0001320 A1 * 1/2017 Hodgson ..... B26B 21/521
2017/0001322 A1 * 1/2017 Shorey ..... B26B 21/522
2017/0225345 A1 * 8/2017 Burrowes ..... B26B 21/446
2017/0320221 A1 * 11/2017 Hawes ..... B26B 21/446
2017/0368702 A1 * 12/2017 Wain ..... B26B 21/446
2018/0009122 A1 * 1/2018 Bruce ..... B26B 21/522

FOREIGN PATENT DOCUMENTS

GB 2 246 314 A 1/1992
WO WO 98/08660 3/1998

* cited by examiner

FLUID DISPENSING HAIR REMOVAL DEVICE

CROSS REFERENCE TO RELATED APPLICATION

This application claims priority to U.S. provisional patent application No. 61/106,258 to Hawes et al, filed Oct. 17, 2008.

FIELD OF THE INVENTION

The present invention concerns hair removal devices, such as razors, which are capable of dispensing a fluid during use.

BACKGROUND OF THE INVENTION

Shaving devices capable of dispensing a fluid, such as a shaving preparation or a lubricant are known, but have a number of shortcomings.

A problem associated with some prior art fluid-dispensing razors is that the fluid is loaded directly into a reservoir disposed within the razor such that, on dispensing, it may be replaced by and come into contact with ambient air or, alternatively, it may directly contact the dispensing mechanism. These kinds of executions raise the prospect of contamination, which, for a device such as a razor, is a problem that must be avoided, especially if fluid remains in the razor between shaves, allowing microbial build-up. Such an execution is known from WO 05/058560 A1.

FR-A-2 629 385 discloses a razor having an aerosol cartridge. Such devices are complex and expensive to produce. They also pollute the atmosphere with propellants and, in addition, aerosol canisters are generally not reusable, so must also be disposed of as well. This patent application also suggests replacing the pressurized cartridge with a liquid pump, but provides no details of either how to achieve that, or how to do so in a manner that maintains the product to be dispensed sterile.

WO 05/058560 A1 discloses a fluid dispensing razor having a flexible bladder filled with shaving aid located in the handle. On actuating a button in the handle, a ratchet mechanism advances a piston which compresses the bladder to expel shaving aid through holes located around the shaving blades. This execution is mechanically complex to manufacture and has the disadvantage that the non-uniform application of pressure on the bladder may result in the accumulation of shaving aid in volumes where the pressure is lower, thereby resulting in incomplete emptying of the bladder during use.

WO 05/065897 discloses an arrangement comprising a bladder filled with shaving aid. A pinch roller driven by a drive mechanism serves to compress the bladder and expel the shaving aid. This arrangement is technically very complex.

Reference can also be made to GB 2 246 314 A, which teaches a razor in which a tubular sack of soap is disposed in the handle. Upon squeezing pressure plates in the handle, spring plates are, in turn, pressurized which squeeze the sack to force soap through holes in the shaving head. Once again, the non-uniform application of pressure to the external surface of the sack, may cause soap to accumulate in volumes of lower pressure such that it may not be not possible completely to empty the sack during use.

US 2006/0150386 A1 teaches a similar arrangement to that disclosed in the preceding patent application. According to this patent application, a razor is taught in which a flexible bladder comprising shaving agent is located within the handle. Dispensing takes place by squeezing flexible regions of the handle which act directly on the bladder to compress it and expel shaving agent. Once again, dispensing in this manner may result in incomplete emptying of the bladder and a concomitant waste of shaving agent.

It would be desirable to provide a fluid-dispensing hair removal device, which is mechanically simple to construct, which does not allow the fluid to come into contact with ambient air or the dispensing mechanism and which permits a more complete dispensing of fluid during use than traditional fluid-dispensing hair removal devices.

SUMMARY OF THE INVENTION

According to the invention, a hair removal device is provided, comprising a handle and a collapsible reservoir suitable for containing a fluid to be dispensed during use of the hair removal device, the hair removal device additionally comprising a deformably rigid container enclosing the collapsible reservoir, a fluid outlet adapted to allow fluid to exit both the collapsible reservoir and the deformably rigid container, a first one-way valve adapted to allow air to enter but not exit the deformably rigid container, and a pressure applicator, adapted to pressurize air in the deformably rigid container, thereby collapsing the collapsible reservoir and causing fluid to be expelled through fluid outlet.

BRIEF DESCRIPTION OF THE DRAWINGS

FIGS. 3A and 3B represent a detailed view of a particular embodiment of the present invention, illustrating how fluid may flow out of the hair removal device and air may flow in.

DETAILED DESCRIPTION OF THE INVENTION

Figure 1:
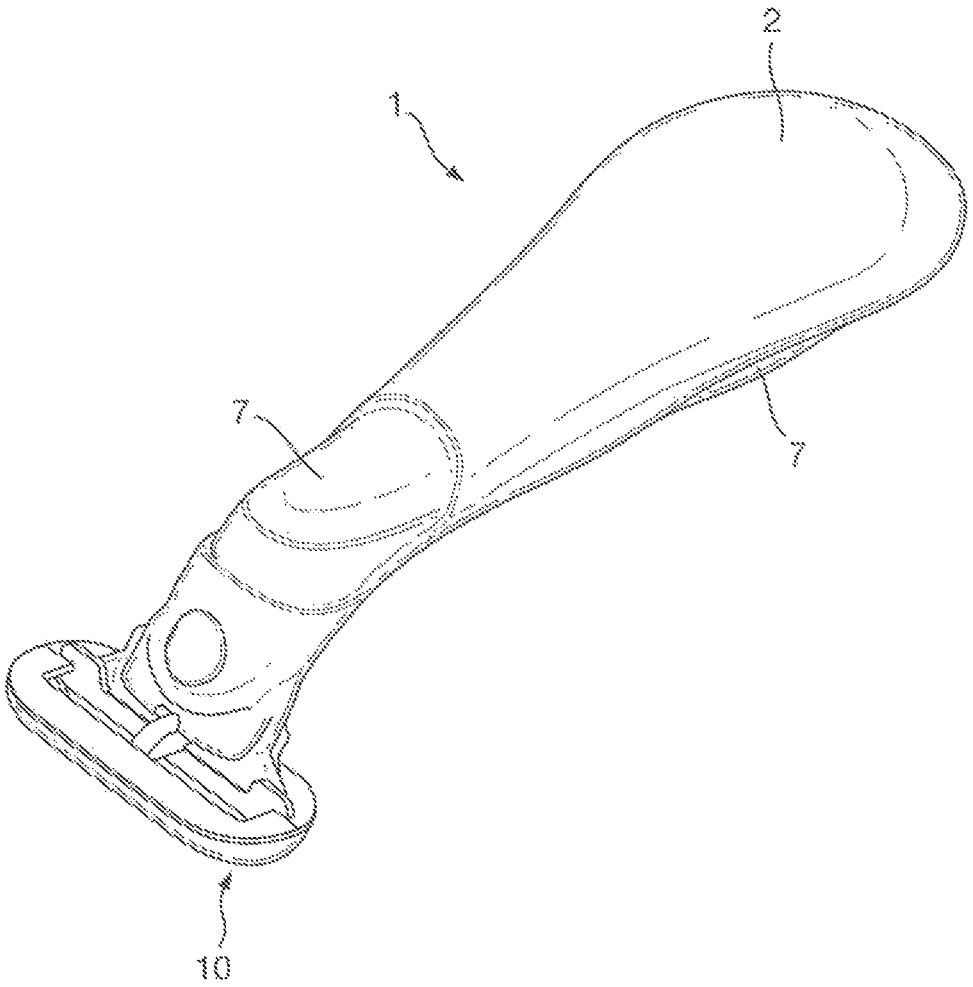
FIG. 1 is a perspective view of a razor according to the present invention.

Hair removal devices according to the present invention comprise fluid disposed within a collapsible reservoir which reservoir is, itself, enclosed within a deformably rigid container. The deformably rigid container which encloses the collapsible reservoir must be sufficiently rigid not to collapse at the same time as the collapsible reservoir, although, as discussed below, it can comprise deformable, non-rigid portion(s) as pressure applicator(s). Suitably deformably rigid materials of construction of the deformably rigid container include polyethylene, polypropylene, PET, PVC, and mixtures thereof. The deformably rigid container may be comprised within the handle of the fluid-dispensing hair removal device or, indeed, the handle of the fluid-dispensing hair removal device may itself define the deformably rigid container. If the handle defines the deformably rigid container, then the handle must be sufficiently deformably rigid not only to retain its shape as the collapsible reservoir collapses, but also to function as a handle.

The collapsible reservoir may be manufactured separately from and then introduced into the deformably rigid container or the two may be manufactured together in a single process.

In a preferred manufacturing process, the two are manufactured together in a single process, such that, following manufacture and prior to use, the collapsible reservoir is removably laminated to the deformably rigid container. An exemplary process includes extrusion blow molding of a multi-layer parison comprising an outer layer, which will become the deformably rigid container, an inner layer, which will become the collapsible reservoir and an intermediate layer, between the inner layer and the outer layer, which serves to prevent the inner and outer layers from permanently adhering to one another. The intermediate layer may extend over the entire interfacial surface between the inner and outer layers, or may be left out at some important locations at the interface, such as at a fluid outlet, in order to effect bonding between the inner and outer layers at that or those locations and thereby prevent delamination in those locations. During the manufacturing process, the multi-layer parison is extruded and then blown. In subsequent use, air forced between the inner and outer layers acts to "delaminate" or peel away the inner layer forming the collapsible reservoir. The collapsible reservoir thereby becomes separated from the outer layer forming the defomably rigid container, while the outer layer enclosing the collapsible reservoir essentially retains its shape.

In an alternative, preferred manufacturing process, injection-moulded inner and outer pre-forms are assembled together and then subsequently blow-moulded to form the collapsible reservoir and the deformably rigid container.

Typical materials of construction of the collapsible reservoir include nylon, PET, PVC, LDPE polypropylene, and mixtures thereof. Evidently, if the collapsible reservoir and the deformably rigid container enclosing it are made of similar or identical materials, then the necessary differences in rigidity will be achieved in ways known to the skilled person, such as via differences in wall thicknesses. Reference may be made to the following documents which discuss technologies for making so-called "delaminating" or "multi-layer" containers: U.S. Pat. No. 5,316,135; U.S. Pat. No. 5,447,687; U.S. Pat. No. 5,501,625; U.S. Pat. No. 6,244,852; U.S. Pat. No. 6,109,468; U.S. Pat. No. 5,435,452; U.S. Pat. No. 5,513,761; U.S. Pat. No. 5,567,377; U.S. Pat. No. 5,711,454; U.S. Pat. No. 5,921,438; U.S. Pat. No. 6,691,494; U.S. Pat. No. 6,266,943; U.S. Pat. No. 6,691,494; U.S. Pat. No. 6,266,943; U.S. Pat. No. 6,670,007.

The collapsible reservoir must be contained within the deformably rigid container in such a fashion that any air introduced into the deformably rigid container will serve to pressurize it and collapse the collapsible reservoir, rather than flowing out again. It is desired that air introduced into the deformably rigid container acts to pressurize the contents of the container, as such, in one embodiment the container does not contain any air outlets. As a result in one embodiment, the air inlet comprises a first one-way valve that allows air in but not out. Suitable one-way valves include umbrella or flapper valves and are known to the person skilled in the art.

The fluid comprised within the collapsible reservoir must be allowed to exit the collapsible reservoir and the deformably rigid container for use during the hair removal process. To facilitate this, an opening is provided in the collapsible reservoir and a further opening is provided within the deformably rigid container and these openings are aligned with one another and connected together during the manufacturing process to provide a fluid outlet.

The collapsible reservoir must be connected to the deformably rigid container in such a way at the fluid outlet that air cannot escape from the container. This seal may be effected in a number of ways known by the skilled person. One such way is described above and involves the collapsible reservoir and the deformably rigid container being bonded together during the manufacturing process by virtue of their comprising materials which naturally bond and by virtue of omitting any intermediate layer in the vicinity of the fluid outlet to prevent such bonding. More typically, the collapsible reservoir and the deformably rigid container are arranged such as to be mechanically sealed together at the fluid outlet. For example, the relative sizes of the deformably rigid container and the collapsible reservoir at the fluid outlet may be such that they are forced together. If the collapsible reservoir and the deformably rigid container are manufactured together in a single manufacturing process, then an air-tight seal, such as a mechanical seal, may automatically result from that manufacturing process.

Advantageously, the fluid outlet is provided with a second one-way valve to allow fluid to exit but not enter the collapsible reservoir. This has the advantage of reducing the possibility of contamination of the fluid by contaminated air or by contaminated fluid being drawn back into the collapsible reservoir. Suitable one-way valves include duck-bill valves, flapper valves, slit valves and umbrella valves.

In order to pressurize the air in the deformably rigid container and cause the collapsible reservoir to collapse, the hair removal device must comprise a pressure applicator. In a simple form, when the collapsible reservoir is comprised within the handle, such a pressure applicator may simply comprise deformable portions of the handle. Such deformable portions may suitably be made of plastic or elastomeric material having memory, such that, following deformation from its rest position, it will tend to return to that rest position after removal of the depression force. In use, on depressing such a deformable portion, the air within the deformably rigid container is compressed, serving to collapse the collapsible reservoir and force fluid out of the reservoir for use during the hair removal process. As soon as the user ceases to depress the deformable portion, it returns to its rest position giving rise to an under-pressure within the deformably rigid container, which is compensated by air flowing into the container through the first one-way valve. Hair removal devices according to the invention may comprise one or more pressure applicators. In the event that the hair removal device comprises a plurality of pressure applicators, then the pressure applicators may have different capacities for applying pressure. For example, one pressure applicator may only apply a small pressure, thereby effecting the dispensing of a small amount of fluid, whereas another applicator may apply a larger pressure and effect the dispensing of a larger amount of fluid. The different applicators may also comprise information for the consumer to inform them of the different dispensing capacities.

Ideally, the pressure applicator facilitates the displacement of an accurately repeatable amount of air that ideally corresponds to an accurately repeatable dispensed dosage of fluid from the hair removal device. Such a dosage may be at any desirable level, but is advantageously from 0.001 to 4 ml. A suitable device for displacing the same amount of air each time is a so-called "mono-stable button". As used herein, a mono-stable button is a button which, when depressed from its rest position, displaces a fixed volume of air, but then returns to its rest position immediately thereafter. In displacing a fixed amount of air, it causes essentially the same amount of fluid to be displaced from the hair removal device. Mono-stable buttons are frequently used on telephone key pads and for pumping fluid and priming liquid systems, such as in petrol engines. Suitable mono-stable buttons are known to those skilled in the art.

Preferably, the pressure applicator(s) will give a signal, such as a tactile signal, for example a click, to the user, that they have been actuated and, therefore, that dispensing shall occur.

In a further advantageous embodiment, the hair removal device may comprise a plurality of pressure applicators disposed at different locations on the handle, to allow the user to grip the handle in a plurality of different ways and yet still facilitate fluid dispensing. For example, a user may grip the handle in an entirely different way if he or she is holding the device vertically or horizontally, or making a long shaving stroke along a leg, or a short one on an under-arm or the face. In order to facilitate simple fluid dispensing in both orientations, the hair removal device may comprise a plurality of pressure applicators at situated different locations, such as on different parts of the handle, so that at least one is always within comfortable range of a user's finger.

Once fluid leaves the fluid outlet it enters the head of the hair removal device to be distributed onto the skin of the user. This may take place through one or more holes or slits in the skin-facing surface of the head.

In one embodiment, the head of the hair removal device comprises an applicator for dispensing the fluid. In one embodiment, the applicator is flat and wide for dispensing a thin but wide ribbon of the fluid. In one embodiment, the applicator forms a dispensing orifice comprising a smaller orifice dimension having a length of from about 0.5 mm to about 10 mm, alternatively from about 1 mm to about 3 mm, and a larger orifice dimension having a length of from about 20 mm to about 80 mm, alternatively from about 30 mm to about 70 mm, alternatively from about 40 mm to about 50 mm. Preferably, the smaller orifice dimension is a vertical dimension and the larger orifice dimension is a horizontal dimension. The smaller and larger orifice dimensions are measured as the vertical and horizontal distances, respectively between opposing edges of the applicator which forms the orifice. This type of applicator is particularly suitable when the device contains a depilatory, a lubricating fluid, a moisturizer, or any other suitable hair removal composition. In one embodiment, the applicator has a spreading member which is separate from the dispensing orifice. When a spreading member is used, the device can dispense the fluid via one or more holes or slits which can be positioned proximally towards the handle (where the spreading member is positioned distally away from the deformably rigid container) such that when the user is pulling the device in a direction towards the handle, fluid can be dispersed and the spreading member can be used to spread the fluid onto the skin surface. In one embodiment, the spreading member has a length of from about 20 mm to about 80 mm, alternatively from about 30 mm to about 70 mm, alternatively from about 40 mm to about 50 mm.

In one embodiment, the applicator has a skin contacting edge which is flat, concave or convex. Those of skill in the art will understand that different shapes for the skin contacting edge can be preferred based on the desired part of the body upon which the device is intended for use. For example, a hair removal device intended for use on the face may have an applicator having a straight edge. A hair removal device intended for use on legs may have an applicator having a concave edge. Non-limiting examples of suitable head configurations are disclosed in U.S. Design Pat. No. D399,601 to Desnos, U.S. Pat. No. D203,892 to Muscatiello, and U.S. Pat. No. 651,420 to Haglock; U.S. Pat. No. 3,088,470 to Hall, U.S. Pat. No. 3,858,985 to Fiveash, 2004 0168743A1 to Garwood; WO Publ. No. 97/18043A1 to Weiss; and GB 1 390 153 to Laboratorio Guidotti & C. S.p.A.

Those of skill in the art will understand that the applicator can also serve as a dispensing member for a second fluid. In one embodiment, the applicator would include a slit type orifice which could remain in a closed orientation until pressure is applied, opening the slit type orifice and allowing fluid to dispense.

The handle of the hair removal device may be permanently or removably fixed to the hair removal device. Advantageously, the handle is detachable from the hair removal device. If the handle comprises the deformably rigid container enclosing the collapsible reservoir, then such an arrangement facilitates replacement of the collapsible reservoir. In such a case, if the reservoir is empty, then the handle, comprising the deformably rigid container and collapsible reservoir are simply removed and replaced by a new handle comprising a deformably rigid container enclosing a new collapsible reservoir which is full of fluid. The empty handle can then be recycled.

The fluid-dispensing hair removal device according to the invention may be a shaving device, such as a razor, but is not limited to such devices and may instead be a device which employs other means, such as light, especially laser light, or even depilatories (as disclosed in U.S. Pat. Nos. 4,618,344, 5,645,825A, 6,743,419, and US Patent Publication US2004/0228820A1), to remove hair. In one embodiment, the hair removal device comprises at least one of a razor, a scraping edge or scraper, a light, and a depilatory, optionally more than one. Like the spreading edge, the scraper or scraping edge can be straight, concave or convex shaped.

For the event that the hair removal device is a razor, then the razor cartridge comprising the blades may be permanently or removably fixed to hair removal device. Advantageously, the cartridge is detachable from the hair removal device, such that it may be replaced, as needed.

The fluid comprised within the reservoir of the hair removal device is advantageously a cosmetic fluid, more preferably a shaving preparation. Examples of such fluids include, but are not limited to; oil-in-water emulsions, water-in-oil emulsions, single phase aqueous polymer solutions, high level surfactant based solutions. Within such fluids, additional ingredients may be incorporated, examples of which include: high molecular weight polymers, cationically charged polymers, lipid based materials, silicone based compounds, surfactants, vitamins and vitamin derivatives, skin conditioning agents, hair removal waxes, other hair removal compositions, and depilatories.

Reference is made to the figures, which disclose a non-limiting embodiment of the invention. FIG. 1 illustrates a hair removal device (1) is disclosed in the form of a razor, having a shaving cartridge (10) comprising one or more blades (shown in FIG. 2A, element 200). The razor comprises a handle (2) which acts as the deformably rigid container (4) enclosing a collapsible reservoir, which, in turn, contains fluid, such as shaving aid, to be dispensed. Pressure applicators (7) may also be seen, which are configured as flexible portions of the handle (2). These pressure applicators (7) may be depressed by a user to pressurize the air space in the handle and thereby also the collapsible reservoir (3), thereby forcing fluid out of the collapsible reservoir (3).

Figure 2A:
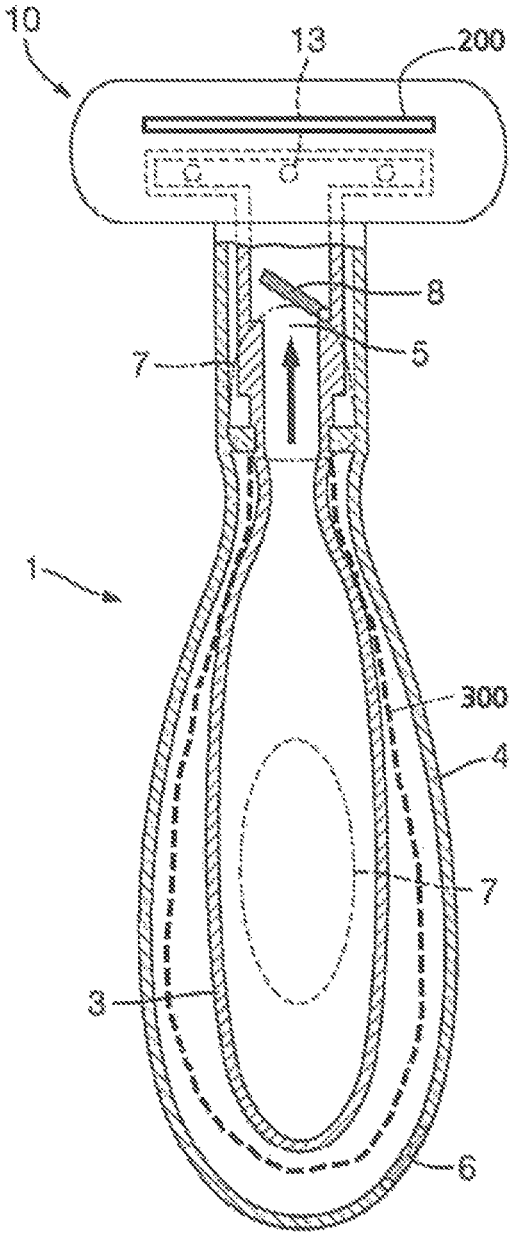
FIG. 2A is a schematic view of a razor according to the present invention, illustrating valves in fluid dispensing mode.
Figure 2B:
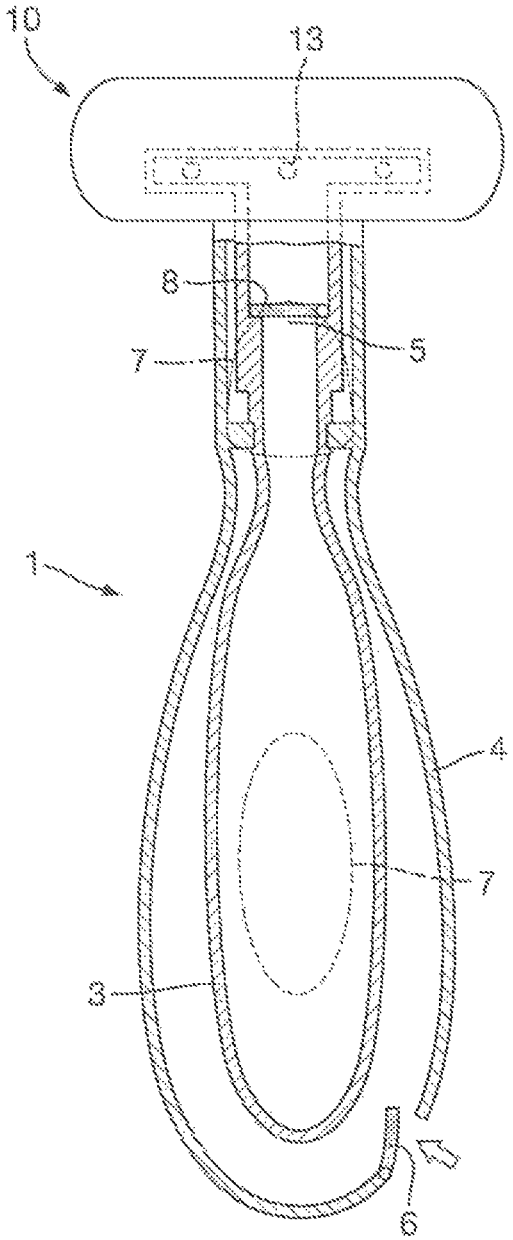
FIG. 2B is a schematic view of a razor according to the present invention, illustrating valves in air intake mode.

FIGS. 2A and 2B are schematic drawings, illustrating some important functional aspects of the hair removal device (1) of FIG. 1 wherein the device comprises at least one port (13) to allow the fluid to be dispensed out of the shaving cartridge (10). In this embodiment, multiple ports are shown, positioned across the length of the shaving cartridge.

FIG. 2A illustrates the deformably rigid container (4), which may also be the handle, which encloses the collapsible reservoir (3). Pressure applicators (7) may also be seen. These are configured as flexible portions of the handle which have memory. In use they may be depressed on application of force by a user. Following removal of the applied force, they return to their rest state. Importantly, first one-way valve (6) is also shown, which functions to allow air to enter the deformably rigid container (4) but not exit. In FIG. 2A, this valve is shut, because the device is in fluid-dispensing mode. As a result, fluid contained within the collapsible reservoir is being expelled (as indicated by the arrow) through fluid outlet (5) via second one-way valve (8), which is open. This has been effected by depressing, one or more of the pressure applicators (7) to compress the air in deformably rigid container (4) and thereby also compress the collapsible reservoir (3). This, in turn, causes fluid contained within the collapsible reservoir to be expelled via fluid outlet (5).

The features shown in FIG. 2B are identical to those shown in FIG. 2A, except that this figure illustrates the valves in air-intake mode: following release of the force applied by the user, the pressure applicator (7) returns to its rest state, thereby generating an under-pressure in the deformably rigid container (4), which, in turn, serves to draw air in via first one-way valve (6), as shown by the arrow, to allow the pressure to equilibrate within the deformably rigid container (4). As a result, first one-way valve (6) is shown open in this figure, whereas the absence of pressure on second one-way valve (8) has caused it to close, as shown.

Figure 3A:
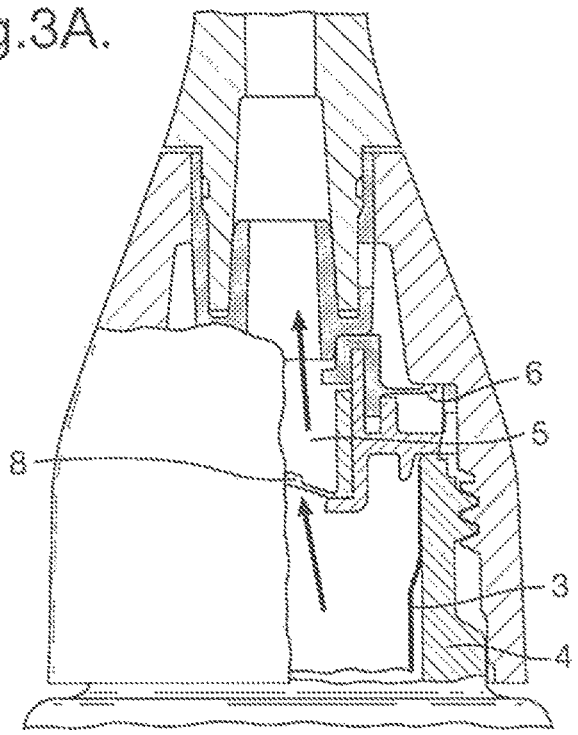
Figure 3B:
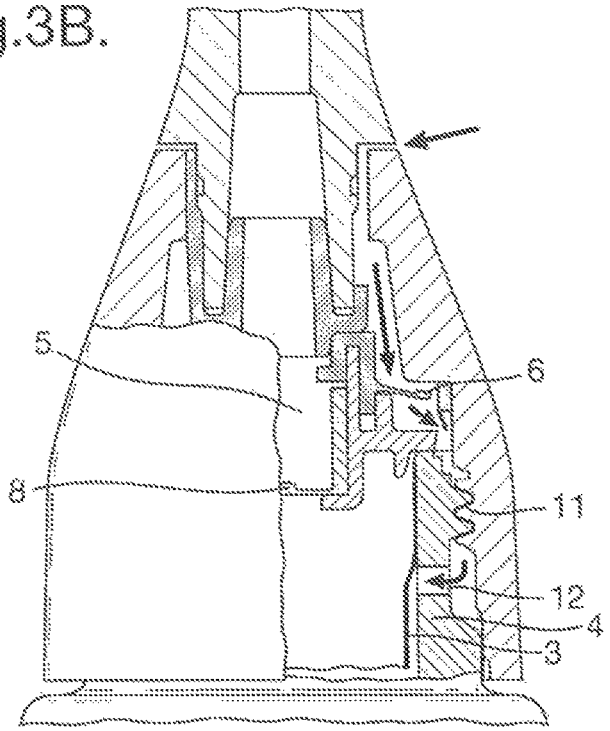

FIGS. 3A and 3B illustrate a working embodiment of a valve system. Once again, The collapsible reservoir (3) and the deformably rigid container (4) are shown. With reference to FIG. 3A, in response to a pressure increase in the deformably rigid container (4), fluid flows in the direction shown by the arrows through the fluid outlet (5), which is equipped with second one-way valve (8) to prevent fluid re-entry. Air may not flow into the deformably rigid container (4), because first one-way valve (6) is forced shut by the increased pressure. With reference to FIG. 3B, in response to a pressure decrease in the deformably rigid container (4), second one-way valve (8) is forced shut, but first one-way valve (6) opens to allow air to flow in the direction of the arrows. There is an air gap (not shown) through threaded portion (11) to allow air to flow through an opening (12) and thereby into the space between the collapsible reservoir (3) and the deformably rigid container (4).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hair removal device comprising:

a shaving cartridge having at least one blade;

a collapsible reservoir suitable for containing a fluid to be dispensed during use of the hair removal device;

a handle forming a deformably rigid container enclosing said collapsible reservoir; and an intermediate layer between at least a part of the collapsible reservoir and the deformably rigid container;

a fluid outlet adapted to allow fluid to dispense from collapsible reservoir to the shaving cartridge, said fluid outlet defined by said collapsible reservoir, wherein the container comprises a mono-stable button adapted to pressurize air in the deformably rigid container, thereby collapsing the collapsible reservoir and causing fluid to be dispensed; and a first one-way valve adapted to allow air to enter the deformably rigid container when the mono-stable button is actuated but not exit the deformably rigid container, said first one way valve formed on said deformably rigid container, wherein said deformably rigid container is free of any air outlet aside from the fluid outlet.

2. The hair removal device of claim 1, additionally comprising a second one-way valve disposed at said fluid outlet, to allow fluid to exit but not enter the reservoir.

3. The hair removal device according to claim 1, wherein the mono-stable button ensures that essentially the same amount of air is displaced and a dose of fluid is dispensed every time pressure is applied.

4. The hair removal device of claim 1, wherein the device is a razor.

5. The hair removal device of claim 1, further comprising a fluid within said collapsible reservoir, wherein said fluid is a depilatory composition.

6. The hair removal device of claim 1, further comprising a fluid within said collapsible reservoir, wherein said fluid is a shaving preparation.

7. The hair removal device of claim 1, wherein the fluid outlet comprises multiple dispense points formed on said shaving cartridge.

8. The hair removal device of claim 1, wherein said mono-stable button provides a tactile signal upon dispensing.

* * * * *